US009267742B2

(12) United States Patent
Bera et al.

(10) Patent No.: US 9,267,742 B2
(45) Date of Patent: Feb. 23, 2016

(54) APPARATUS FOR CONTROLLING THE TEMPERATURE UNIFORMITY OF A SUBSTRATE

(75) Inventors: Kallol Bera, San Jose, CA (US); Xiaoping Zhou, San Jose, CA (US); Douglas A. Buchberger, Jr., Livermore, CA (US); Andrew Nguyen, San Jose, CA (US); Hamid Tavassoli, Cupertino, CA (US); Surajit Kumar, Sunnyvale, CA (US); Shahid Rauf, Pleasanton, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 1137 days.

(21) Appl. No.: 12/886,255

(22) Filed: Sep. 20, 2010

(65) Prior Publication Data

US 2011/0180243 A1 Jul. 28, 2011

Related U.S. Application Data

(60) Provisional application No. 61/298,671, filed on Jan. 27, 2010.

(51) Int. Cl.

| | |
|---|---|
| ***F25B 29/00*** | (2006.01) |
| ***F28F 3/12*** | (2006.01) |
| *F28F 13/00* | (2006.01) |

(52) U.S. Cl.

CPC ..... *F28F 3/12* (2013.01); *F28F 2013/001* (2013.01)

(58) Field of Classification Search

CPC ..... F28F 3/12; F28F 2013/001
USPC ..... 165/206, 61, 64, 170, 168; 118/724, 118/725, 726, 728; 156/345.51, 345.52, 156/345.53

See application file for complete search history.

(56) References Cited

U.S. PATENT DOCUMENTS

| | | | | |
|---|---|---|---|---|
| 5,192,849 | A * | 3/1993 | Moslehi | 219/121.43 |
| 5,802,856 | A * | 9/1998 | Schaper et al. | 165/206 |
| 7,094,994 | B2 * | 8/2006 | Oyama et al. | 118/724 |
| 7,436,645 | B2 | 10/2008 | Holland et al. | |
| 8,955,579 | B2 * | 2/2015 | Tandou et al. | 118/724 |

(Continued)

FOREIGN PATENT DOCUMENTS

| | | | |
|---|---|---|---|
| JP | 07-263526 | A | 10/1995 |
| JP | 2002373875 | A * | 12/2002 |

(Continued)

OTHER PUBLICATIONS

International Search Report and Written Opinion mailed Sep. 23, 2011 for PCT Application No. PCT/US2011/022201.

(Continued)

*Primary Examiner* — Ljiljana Ciric
(74) *Attorney, Agent, or Firm* — Moser Taboada; Alan Taboada

(57) ABSTRACT

Apparatus for controlling the thermal uniformity of a substrate. In some embodiments, the thermal uniformity of the substrate is controlled to be more uniform. In some embodiments, the thermal uniformity of the substrate is controlled to be non-uniform in a desired pattern. In some embodiments, an apparatus for controlling thermal uniformity of a substrate includes a substrate support having a support surface to support a substrate thereon. A plurality of flow paths having a substantially equivalent fluid conductance are disposed within the substrate support to flow a heat transfer fluid beneath the support surface.

19 Claims, 5 Drawing Sheets

(56) References Cited

U.S. PATENT DOCUMENTS

| | | | | |
|---|---|---|---|---|
| 8,961,691 | B2 * | 2/2015 | Kato et al. | 118/725 |
| 8,967,081 | B2 * | 3/2015 | Borean et al. | 118/724 |
| 8,986,456 | B2 * | 3/2015 | Fondurulia et al. | 118/726 |
| 2003/0164226 | A1 * | 9/2003 | Kanno et al. | 156/345.51 |
| 2007/0039942 | A1 | 2/2007 | Leung et al. | |

FOREIGN PATENT DOCUMENTS

| | | | |
|---|---|---|---|
| KR | 10-0673788 | B1 | 1/2007 |
| KR | 10-2008-0041893 | A | 5/2008 |

OTHER PUBLICATIONS

U.S. Appl. No. 12/886,258, filed Sep. 20, 2010, Bera et al.

* cited by examiner

APPARATUS FOR CONTROLLING THE TEMPERATURE UNIFORMITY OF A SUBSTRATE

CROSS-REFERENCE TO RELATED APPLICATIONS

This application claims benefit of U.S. provisional patent application Ser. No. 61/298,671, filed Jan. 27, 2010, which is herein incorporated by reference.

FIELD

Embodiments of the present invention generally relate to apparatus for substrate processing.

BACKGROUND

In many conventional substrate processes, cooling channels may be provided in a substrate support to facilitate cooling a substrate during the processing thereof to maintain a desired temperature profile on the substrate. The cooling channels may be configured to facilitate providing a desired temperature profile of the substrate during processing.

The inventors have provided an improved apparatus for controlling the temperature of a substrate during processing.

SUMMARY

Apparatus for controlling thermal uniformity of a substrate are provided herein. In some embodiments, the thermal uniformity of the substrate may be controlled to be more uniform. In some embodiments, the thermal uniformity of the substrate may be controlled to be non-uniform in a desired pattern. In some embodiments, an apparatus for controlling thermal uniformity of a substrate may include a substrate support having a support surface to support a substrate thereon; and a plurality of flow paths having a substantially equivalent fluid conductance disposed within the substrate support to flow a heat transfer fluid beneath the support surface.

In some embodiments, an apparatus for controlling thermal uniformity of a substrate may include a substrate support having a support surface to support a substrate thereon; and a flow path disposed within the substrate support to flow a heat transfer fluid beneath the support surface, wherein the flow path comprises a first portion and a second portion, each portion having a substantially equivalent axial length, wherein the first portion is spaced about 2 mm to about 10 mm from the second portion, and wherein the first portion provides a flow of heat transfer fluid in a direction opposite a flow of heat transfer fluid of the second portion.

The above summary is provided to briefly discuss some aspects of the present invention and is not intended to be limiting of the scope of the invention. Other embodiments and variations of the invention are provided below in the detailed description.

BRIEF DESCRIPTION OF THE DRAWINGS

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of this invention and are therefore not to be considered limiting of its scope, for the invention may admit to other equally effective embodiments.

Figure 1:
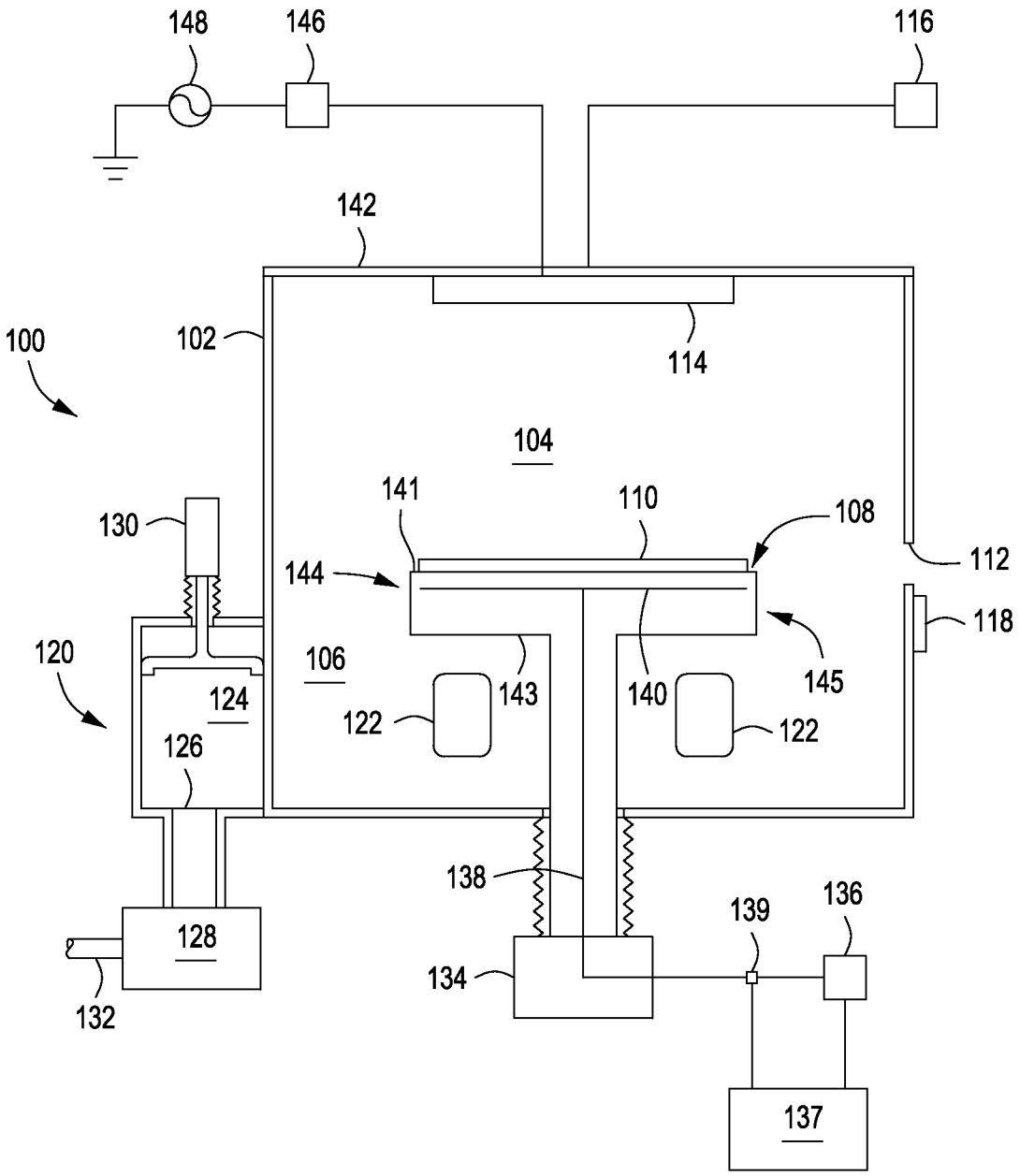
FIG. 1 depicts a process chamber having an apparatus for controlling temperature of a substrate in accordance with some embodiments of the present invention.

To facilitate understanding, identical reference numerals have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

The inventors have observed that substrates processed with conventional substrate supports may have undesirable temperature profiles, which may lead to undesirable process results. Embodiments of the present invention provide apparatus for controlling the temperature of a substrate during processing. The apparatus may control the thermal uniformity of the substrate during processing. In some embodiments, the thermal uniformity of the substrate may be controlled to be more uniform. In some embodiments, the thermal uniformity of the substrate may be controlled to be non-uniform in a desired pattern. In some embodiments, the inventive apparatus may advantageously provide one or more flow paths which provide a counter flow of heat transfer fluid, thereby facilitating control of a temperature profile across a substrate support and substrate disposed thereon. In addition, in some embodiments, the inventive apparatus may advantageously provide a substrate support having a plurality of flow paths which provide an increased flow rate of heat transfer fluid, thereby facilitating control of temperature across a substrate support and substrate disposed thereon.

FIG. 1 depicts a process chamber 100 suitable for use in connection with an apparatus for controlling temperature uniformity of a substrate in accordance with some embodiments of the present invention. Exemplary process chambers may include the DPS®, ENABLER®, SIGMA™, ADVANTEDGE™, or other process chambers, available from Applied Materials, Inc. of Santa Clara, Calif. It is contemplated that other suitable chambers include any chambers that may be used to perform any substrate fabrication process.

In some embodiments, the process chamber 100 generally comprises a chamber body 102 defining an inner processing volume 104 and an exhaust volume 106. The inner processing volume 104 may be defined, for example, between a substrate support 108 disposed within the process chamber 100 for supporting a substrate 110 thereupon during processing and one or more gas inlets, such as a showerhead 114 and/or nozzles provided at desired locations. The exhaust volume may be defined, for example, between the substrate support 108 and a bottom of the process chamber 102.

The substrate 110 may enter the process chamber 100 via an opening 112 in the chamber body 102. The opening 112 may be selectively sealed via a slit valve 118, or other mechanism for selectively providing access to the interior of the chamber through the opening 112. The substrate support 108, described more fully below, may be coupled to a lift mechanism 134 that may control the position of the substrate support 108 between a lower position (as shown) suitable for transferring substrates into and out of the chamber via the opening 112 and a selectable upper position suitable for processing. The process position may be selected to maximize process uniformity for a particular process step. When in at least one of the elevated processing positions, the substrate support 108 may be disposed above the opening 112 to provide a symmetrical processing region.

The one or more gas inlets (e.g., the showerhead 114) may be coupled to a gas supply 116 for providing one or more process gases into the processing volume 104 of the process chamber 100. Although a showerhead 114 is shown, additional or alternative gas inlets may be provided such as nozzles or inlets disposed in the ceiling or on the sidewalls of the process chamber 100 or at other locations suitable for providing gases as desired to the process chamber 100, such as the base of the process chamber, the periphery of the substrate support, or the like.

In some embodiments, the showerhead may include one or more mechanisms for controlling the temperature of a substrate-facing surface of the showerhead. Additional details of apparatus for controlling the temperature of the showerhead may be found in U.S. Patent Application 61/298,676, filed Jan. 27, 2010 by K. Bera, et al., and entitled, "APPARATUS FOR CONTROLLING TEMPERATURE UNIFORMITY OF A SHOWERHEAD," which is hereby incorporated by reference in its entirety.

In some embodiments, one or more radio frequency (RF) plasma power sources (one RF plasma power source 148 shown) may be coupled to the process chamber 102 through one or more matching networks 146 for providing power for processing. In some embodiments, the apparatus 100 may utilize capacitively coupled RF power provided to an upper electrode proximate an upper portion of the process chamber 102. The upper electrode may be a conductor in an upper portion of the process chamber 102 or formed, at least in part, by one or more of the ceiling 142, the showerhead 114, or the like, fabricated from a suitable conductive material. For example, in some embodiments, the one or more RF plasma power sources 148 may be coupled to a conductive portion of the ceiling 142 of the process chamber 102 or to a conductive portion of the showerhead 114. The ceiling 142 may be substantially flat, although other types of ceilings, such as dome-shaped ceilings or the like, may also be utilized. The one or more plasma sources may be capable of producing up to 5000 W at a frequency of about 2 MHz and/or about 13.56 MHz, or higher frequency, such as 27 MHz and/or 60 MHz and/or 162 MHz. In some embodiments, two RF power sources may be coupled to the upper electrode through respective matching networks for providing RF power at frequencies of about 2 MHz and about 13.56 MHz. Alternatively, the one or more RF power sources may be coupled to inductive coil elements (not shown) disposed proximate the ceiling of the process chamber 102 to form a plasma with inductively coupled RF power.

In some embodiments, the inner process volume 104 may be fluidly coupled to the exhaust system 120. The exhaust system 120 may facilitate uniform flow of the exhaust gases from the inner process volume 104 of the process chamber 102. The exhaust system 120 generally includes a pumping plenum 124 and a plurality of conduits (not shown) that couple the pumping plenum 124 to the inner process volume 104 of the process chamber 102. Each conduit has an inlet 122 coupled to the inner process volume 104 (or, in some embodiments, the exhaust volume 106) and an outlet (not shown) fluidly coupled to the pumping plenum 124. For example, each conduit may have an inlet 122 disposed in a lower region of a sidewall or a floor of the process chamber 102. In some embodiments, the inlets are substantially equidistantly spaced from each other.

A vacuum pump 128 may be coupled to the pumping plenum 124 via a pumping port 126 for pumping out the exhaust gases from the process chamber 102. The vacuum pump 128 may be fluidly coupled to an exhaust outlet 132 for routing the exhaust as required to appropriate exhaust handling equipment. A valve 130 (such as a gate valve, or the like) may be disposed in the pumping plenum 124 to facilitate control of the flow rate of the exhaust gases in combination with the operation of the vacuum pump 128. Although a z-motion gate valve is shown, any suitable, process compatible valve for controlling the flow of the exhaust may be utilized.

The substrate support 108 generally comprises a body 143 having a substrate support surface 141 for supporting a substrate 110 thereon. In some embodiments, the substrate support 108 may include a mechanism that retains or supports the substrate 110 on the surface of the substrate support 108, such as an electrostatic chuck, a vacuum chuck, a substrate retaining clamp, or the like (not shown).

In some embodiments, the substrate support 108 may include an RF bias electrode (not shown). The RF bias electrode may be coupled to one or more bias power sources through one or more respective matching networks. The one or more bias power sources may be capable of producing up to 12000 W at a frequency of about 2 MHz, or about 13.56 MHz, or about 60 MHz. In some embodiments, two bias power sources may be provided for coupling RF power through respective matching networks to the RF bias electrode at a frequency of about 2 MHz and about 13.56 MHz. In some embodiments, three bias power sources may be provided for coupling RF power through respective matching networks to the RF bias electrode at a frequency of about 2 MHz, about 13.56 MHz, and about 60 MHz. The at least one bias power source may provide either continuous or pulsed power. In some embodiments, the bias power source may be a DC or pulsed DC source.

In some embodiments, the substrate support 108 may include one or more mechanisms for controlling the temperature of the substrate support surface 141 and the substrate 110 disposed thereon. For example, a one or more channels 140 may be provided to define one or more flow paths (described more fully below with respect to FIGS. 2-7) beneath the substrate support surface 141 to flow a heat transfer fluid. The heat transfer fluid may comprise any fluid suitable to provide adequate transfer of heat to or from the substrate. For example, the heat transfer fluid may be a gas, such as helium (He), oxygen ($O_2$), or the like, or a liquid, such as water, antifreeze, or an alcohol, for example, glycerol, ethylene glycerol, propylene, methanol, or refrigerant fluid such as FREON® (e.g., a chlorofluorocarbon or hydrochlorofluorocarbon refrigerant), ammonia or the like. A heat transfer fluid source 136 may be coupled to conduit 138 to provide the heat transfer fluid to the one or more channels 140. The heat transfer fluid source 136 may comprise a temperature control device, for example a chiller or heater, to control the temperature of the heat transfer fluid. One or more valves 139 (or other flow control devices) may be provided between the heat transfer fluid source 136 and the one or more channels 140 to independently control a rate of flow of the heat transfer fluid to each of the one or more channels 140. A controller 137 may control the operation of the one or more valves 139 and/or of the heat transfer fluid source 136.

The one or more channels 140 may be formed within the substrate support 108 via any means suitable to form the one or more channels 140 having dimensions adequate to flow a heat transfer fluid therethrough. For example, in some embodiments, at least a portion of the one or more channels 140 may be partially machined into one or both of a separable top portion 144 and bottom portion 145 of the substrate support 108. Alternatively, in some embodiments, the one or more channels 140 may be fully machined into one of the top portion 144 or bottom portion 145 of the substrate support 108. In some embodiments, the one or more channels comprise a plurality of channels having substantially equivalent fluid conductance and residence time. In some embodiments, other features may be included in the one or more channels 140 to improve heat transfer between the heat transfer fluid and the substrate support surface 141. For example, one or more fins may be included within each of the one or more channels 140 extending partially or wholly across the one or more channels 140. The fin may provide an increased surface area available for heat transfer, thereby enhancing the heat transfer between the heat transfer fluid flowing through the one or more channels 140 and the substrate support 108.

In some embodiments, in addition to the one or more channels 140, one or more heaters (not shown) may be disposed proximate the substrate support 108 to further facilitate control over the temperature of the substrate support surface 141. The heaters may be any type of heater suitable to provide control over the substrate temperature. For example, the heater may be one or more resistive heaters. In some embodiments the heaters may be disposed above or proximate to the substrate support surface 141. Alternatively, or in combination, in some embodiments, the heaters may be embedded within the substrate support 108. The number and arrangement of the one or more heaters may be varied to provide additional control over the temperature of the substrate 110. For example, in embodiments where more than one heater is utilized, the heaters may be arranged in a plurality of zones to facilitate control over the temperature across the substrate 110, thus providing increased temperature control.

Figure 2:
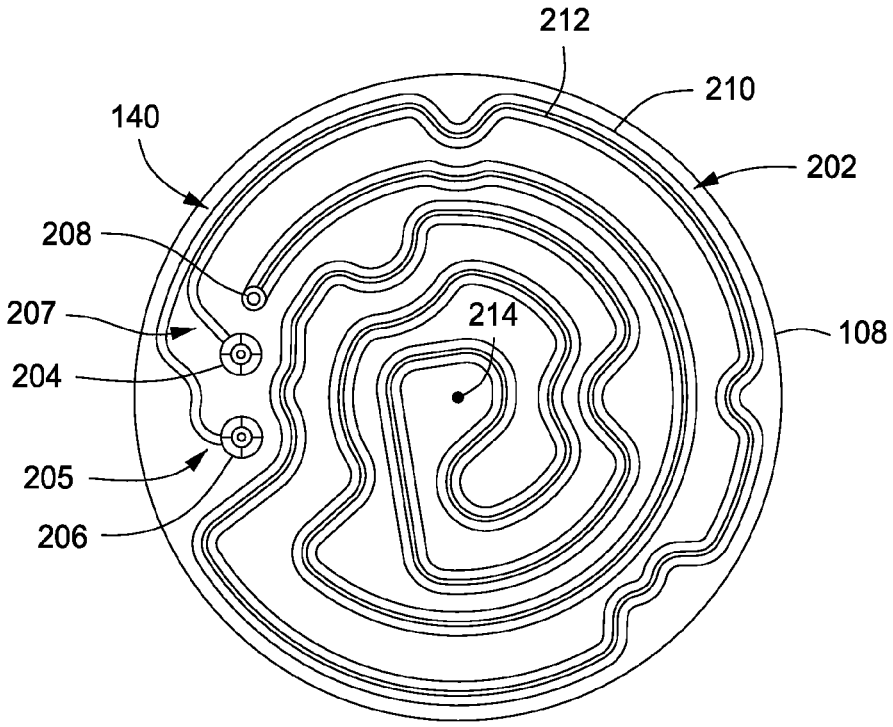
FIGS. 2-6 depict cross sectional top views of apparatus for controlling the temperature of a substrate in accordance with some embodiments of the present invention.

The one or more channels 140 may be configured in any manner suitable to provide adequate control over temperature profile across the substrate support surface 141 and the substrate 110 disposed thereon during processing. For example, in some embodiments and as depicted in FIG. 2, one channel 140 may be formed within the substrate support 108 defining a single flow path 202 having a counter flow configuration. An inlet 206 may be coupled to a first end 205 of the flow path 202 and an outlet 204 coupled to a second end 207 of the flow path 202, thus facilitating a flow of heat transfer fluid from the inlet 206 to the outlet 204. The inlet 206 may be coupled to a heat transfer fluid source (not shown) configured to provide the heat transfer fluid, as described above with respect to FIG. 1. The channel 140 (e.g., flow path 202) may be routed around objects in the base, such as lift pins, lift pin through holes, or the like.

In embodiments where the one or more channels 140 define a single flow path 202, the flow path 202 may comprise a first portion 210 fluidly coupled to a second portion 212 via a loop or coupling 208. In such embodiments, the first portion 210 and second portion 212 each have a substantially equivalent axial length. The axial length is defined as the axial distance between the inlet 206 and the loop 208 for the first portion 210, and the distance between the loop 208 and the outlet 204 for the second portion 212. The first portion 210 and second portion 212 may be disposed proximate one another to facilitate a heat transfer between the first portion 210 and second portion 212. For example, the distance between the first portion 210 and second portion 212 may be about 2 mm to about 30 mm, or between about 2 mm to about 10 mm. In such embodiments, the first portion 210 and second portion 212 are configured to provide a counter flow (flow in opposite direction) of heat transfer fluid having different temperatures, allowing for a heat transfer from a hotter portion of the heat transfer fluid to a cooler portion of the heat transfer fluid, thus improving temperature uniformity between the first portion 210 and second portion 212 at equivalent positions along the respective portions. In some embodiments, the inlet 206 and the outlet 204 may be disposed proximate each other and the first and second portions 210, 212 of the flow path 202 may together generally wind radially inward toward a center point 214 of the substrate support 108 then loop back and generally wind radially outward until the end of the first and second portions 210, 212 is reached at the loop or coupling 208. The inward and outward winding of the first and second portions 210, 212 may be interleaved. With the inlet and the outlet near center, the flow path can first wind outward towards the periphery, then wind inward towards the center. Such a configuration advantageously provides a flow path having dual counter flow—a first counter flow configuration as between immediately adjacent regions of the first and second portions 210, 212 of the flow path 202, and a second counter flow configuration due to the interleaved winding of the adjacent first and second portions 210, 212.

The dual counter flow configuration advantageously provides a low temperature difference between maximum and minimum temperatures of the substrate support. For example, in an exemplary test model run by the inventors, a substrate support having a dual counter flow configuration as described above and a conventional substrate support having a single counter flow configuration were heated uniformly and a coolant was provided in the respective flow paths of the substrate supports to remove heat from the substrate support. Steady state measurements of temperature across the substrate supports yielded a temperature profile in the dual counter flow substrate support that was more uniform than in the conventional substrate support. In addition, the temperature difference between respective maximum and minimum temperature measurements in each substrate support was advantageously lower in the dual counter flow substrate support than in the conventional substrate support.

Figure 3:
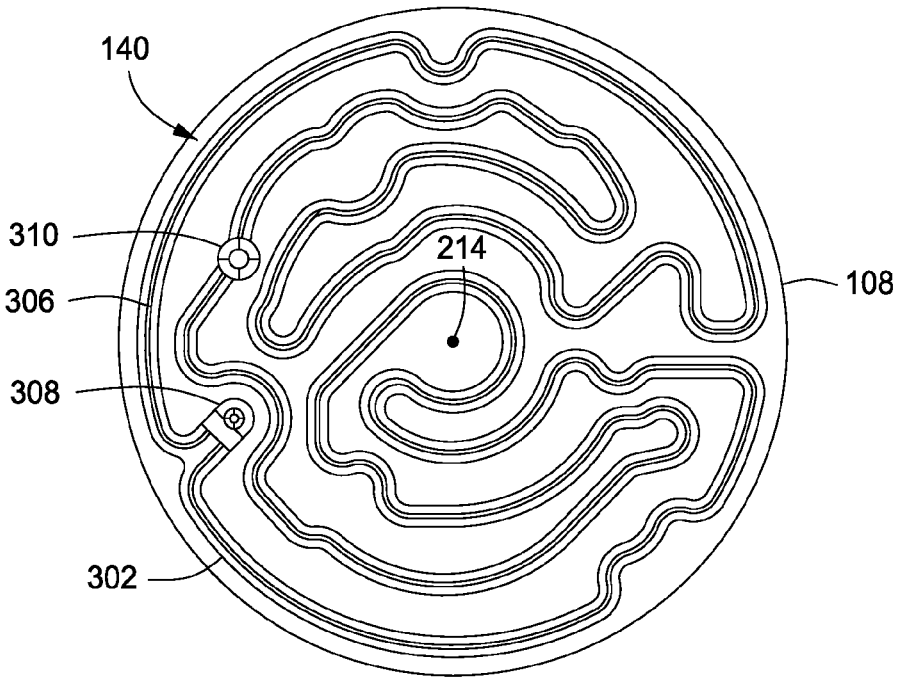

In some embodiments, and as depicted in FIG. 3, one or more channels 140 may define two or more (two shown) flow paths 302, 306 coupled to one another via a common inlet 310 and outlet 308. The two or more flow paths 302, 306 may be arranged in any configuration suitable to provide substantially equal flow of the heat transfer fluid and to provide control over the temperature profile across the substrate support 108. For example, as depicted in FIG. 3, in some embodiments, the two or more flow paths 302, 306 may begin at the inlet 310 and may be routed in different directions to cover different portions of the substrate support.

In some embodiments, the two or more flow paths 302, 306 may have a substantially equivalent axial length, cross-sectional area, thus providing substantially equal fluid conductance and residence time of heat transfer fluid within each of the two or more flow paths 302, 306, thereby facilitating temperature uniformity between the two or more flow paths 302, 306. By providing two or more flow paths 302, 306 the axial length of each of the two or more flow paths 302, 306 may be decreased, as compared to a single flow path covering the same area, thereby providing a shorter flow path for the heat transfer fluid. The shorter flow path for the heat transfer fluid decreases the change in temperature along the length of the two or more flow paths 302, 306 between the inlet 310 and outlet 308 as compared to longer flow paths. In addition, by providing a shorter flow path for the heat transfer fluid a pressure drop of the heat transfer fluid between the inlet 310 and outlet 308 of two or more flow paths 302, 306 may also be decreased, allowing for an increased flow rate of heat transfer fluid, thus further decreasing a change in temperature along the length of the two or more flow paths 302, 306 between the inlet 310 and the outlet 308.

Figure 4:
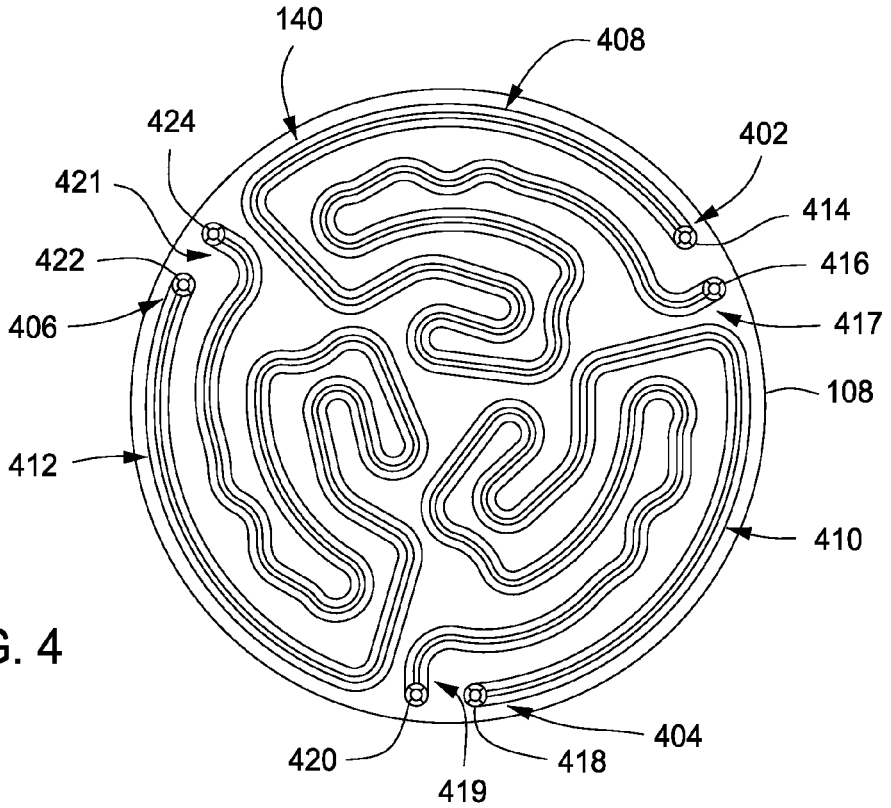

In some embodiments, and as depicted in FIG. 4, the one or more channels 140 may define a plurality of flow paths (three shown) 408, 410, 412 having a substantially equal fluid conductance and residence time. In such embodiments, each of the plurality of flow paths 408, 410, 412 comprises an inlet 414, 418, 422 coupled to a first end 402, 404, 406 and an outlet 416, 420, 424 coupled to a second end 417, 419, 421, thus providing a flow path of heat transfer fluid from the inlet 414, 418, 422 to the respective outlet 416, 420, 424. The plurality of flow paths 408, 410, 412 may be coupled to a single heat transfer fluid source (described above with respect to FIG. 1). For example, a heat transfer fluid outlet may be coupled to the plurality of outlets to provide an outflow of heat transfer fluid from the plurality of outlets to the heat transfer fluid source. Alternatively, the plurality of flow paths may be coupled to a plurality of heat transfer fluid sources, wherein each of the plurality of flow paths 408, 410, 412 are respectively coupled to a separate single heat transfer fluid source.

The plurality of flow paths 408, 410, 412 may be arranged in any manner suitable to provide temperature uniformity throughout the substrate support 108. For example, in some embodiments, the plurality of flow paths 408, 410, 412 may be symmetrically positioned within the substrate support 108 to promote temperature uniformity. By utilizing a plurality of flow paths 408, 410, 412 the axial length of each of the plurality of flow paths 408, 410, 412 may be shortened, which may advantageously allow for a decreased change in temperature of the heat transfer fluid along the flow paths 408, 410, 412 and thus an increased control over temperature profile due to the principles (e.g., residence time, fluid conductance, decreased pressure drop) discussed above with respect to FIG. 3. In addition, by utilizing a plurality of flow paths 408, 410, 412 wherein each comprises an inlet 414, 418, 422, and outlet 416, 420, 424, such as depicted in FIG. 4, the total flow rate of heat transfer fluid throughout the substrate support may be increased, further facilitating a decreased temperature range of the substrate support during use. In some embodiments, each of the plurality of flow paths may be arranged to provide a counter flow within a given flow path. In some embodiments, each portion of the flow path adjacent to another flow path can be configured to provide counter flow. By providing each flow path, and optionally adjacent flow paths, in a counter flow configuration, temperature uniformity further improves.

Figure 5:
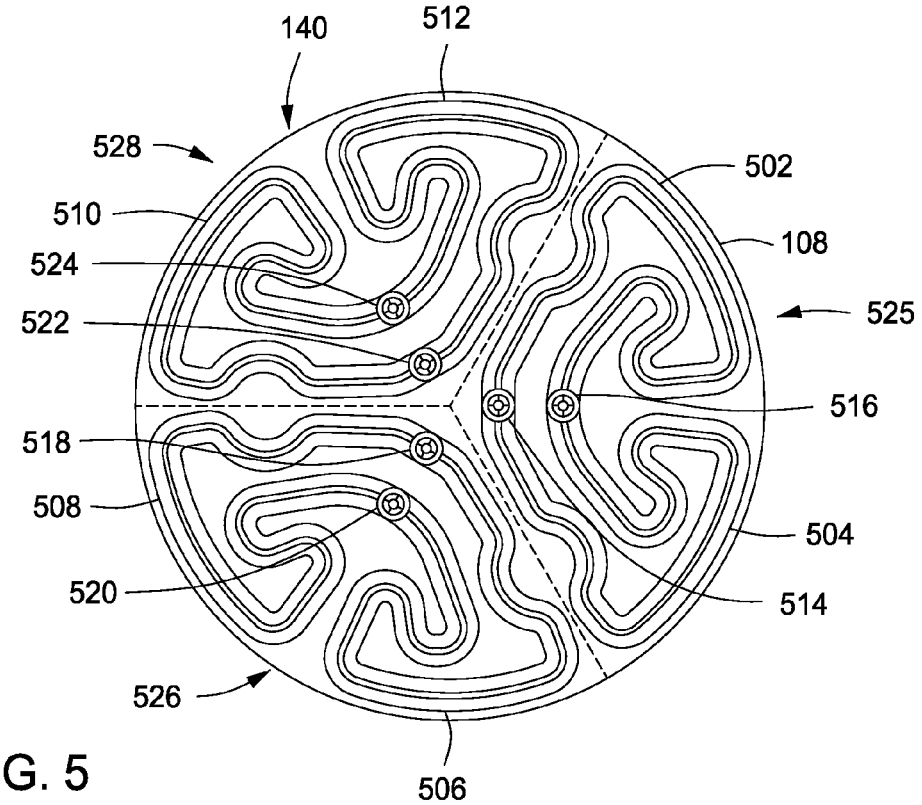

In some embodiments, and as depicted in FIG. 5, the one or more channels 140 may define a plurality of flow paths (six shown) 502, 504, 506, 508, 510, 512 arranged in a plurality of zones 525, 526, 528. The plurality of zones 525, 526, 528 may be arranged in any manner suitable to provide control of a temperature profile across the substrate support 108. For example, as shown in FIG. 5, the zones 525, 526, 528 may have a substantially equivalent surface area and are arranged symmetrically across the substrate support 108. In such embodiments, each zone 525, 526, 528 may comprise two or more of the plurality of flow paths coupled to a common inlet and outlet. For example, as shown in FIG. 5, flow paths 502 and 504 are coupled to a common inlet 514 and a common outlet 516, flow paths 506 and 508 are coupled to inlet 518 and outlet 520, and flow paths 510 and 512 are coupled to inlet 522 and outlet 524. In such embodiments, each of the plurality of flow paths 502, 504, 506, 508, 510, 512 may comprise a substantially equivalent axial length and cross-sectional area, thus providing substantially equal fluid conductance and residence time of heat transfer fluid within each of the plurality of flow paths 502, 504, 506, 508, 510, 512, thereby facilitating temperature uniformity in each of the zones 525, 526, 528. In some embodiments, the common inlets 514, 518, 522 may be coupled to a heat transfer fluid source (not shown) configured to provide the heat transfer fluid, as described above with respect to FIG. 1. Alternatively, in some embodiments, a separate heat transfer fluid source may be coupled to each inlet 514, 518, 522 to provide a heat transfer fluid to each zone 525, 526, 528 individually.

By utilizing two or more of the plurality of flow paths 502, 504, 506, 508, 510, 512 in each zone 525, 526, 528 the axial length of each of the plurality of flow paths 502, 504, 506, 508, 510, 512 may be shortened, which may advantageously allow for a decreased change in temperature of the heat transfer fluid along the flow paths 502, 504, 506, 508, 510, 512 and thus an increased control in temperature uniformity due to the principles discussed above.

Figure 6:
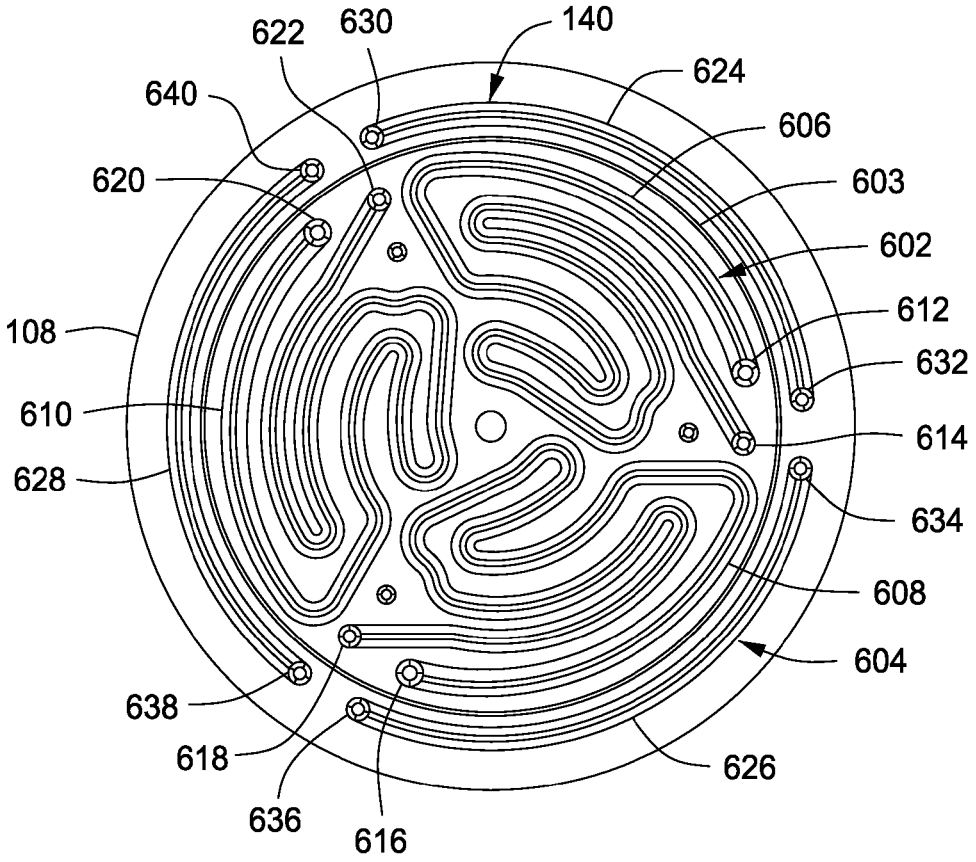

Alternatively, or in combination, in some embodiments and as depicted in FIG. 6, a plurality of flow paths (six shown) 606, 608, 610, 624, 626, 628 may also be arranged in an inner zone 602 and an outer zone 604, wherein the outer zone 604 is disposed radially outward from the inner zone 602. Each of the inner zone 602 and outer zone 604 may comprise any number of the plurality of flow paths 606, 608, 610, 624, 626, 628 and may be arranged in any manner suitable to facilitate temperature uniformity across the substrate support 108. For example, as depicted in FIG. 6, the inner zone 602 may comprise a plurality (three shown) of flow paths 606, 608, 610, having a substantially equivalent axial length and fluid conductance, positioned symmetrically within the substrate support 108. Each of the plurality of flow paths 606, 608, 610 comprises an inlet 612, 616, 620 and an outlet 614, 618, 622. The plurality of flow paths 606, 608, 610 may be coupled to a common heat transfer fluid source (not shown) configured to provide the heat transfer fluid, as described above with respect to FIG. 1. Alternatively, in some embodiments, a separate heat transfer fluid source may be coupled to each inlet 612, 616, 620 to provide a heat transfer fluid to each flow path 606, 608, 610 individually.

In some embodiments, the inner zone 602 may comprise other configurations of flow paths to facilitate temperature uniformity across the substrate support 108. For example, in some embodiments, the inner zone 602 may further comprise a plurality of zones positioned symmetrically, wherein each of the plurality of zones comprise more than one flow path coupled to a common inlet and outlet, such as in the embodiments discussed above with respect to FIG. 5.

In some embodiments, the outer zone 604 may comprise a plurality (three shown) of flow paths 624, 626, 628, wherein each of the plurality of flow paths 624, 626, 628 comprise an inlet 632, 636, 640 and outlet 630, 634, 638. In some embodiments, each of the plurality of flow paths 624, 626, 628 may be disposed adjacent to a corresponding flow path of the plurality of flow paths 606, 608, 610 of the inner zone 602. In such embodiments the plurality (three shown) of flow paths 624, 626, 628 in the outer zone 604 may provide a counter flow of heat transfer fluid with respect to the adjacent flow path of the plurality of flow paths 606, 608, 610 of the inner zone 602, allowing for a heat transfer from a hotter portion of the heat transfer fluid to a cooler portion of the heat transfer fluid, thus facilitating temperature uniformity between the outer zone 604 and inner zone 602. In some embodiments, a barrier 603 may be provided between the inner zone 602 and the outer zone 604 to facilitate the independent control over the temperature in each zone, and temperature non-uniformity between the zones. In some embodiments, the barrier 603 may be an insulator such as an air gap, for example, of about 1 mm to about 10 mm wide.

In embodiments where multiple zones of heat transfer fluid flow paths are provided, a valve (e.g., valve 139 depicted in FIG. 1) may be coupled to at least one, and in some embodiments, each of the plurality of flow paths to control a flow rate of the heat transfer fluid flowing through one or more of the flow paths. A controller may be coupled to each valve to control the operation thereof (e.g., controller 137 depicted in FIG. 1). The each valve may be controlled to independently provide a desired flow rate of heat transfer fluid through the flow paths in each zone. As such, a flow rate in a given zone may be increased or decreased with respect to the flow rate in any other zone. For example, a flow rate in an outer zone may be increased to remove more heat, or decreased to remove less heat, as desired to make a substrate thermal profile more uniform or controllably non-uniform (for example to control process results in thermally dependent processes).

Figure 7:
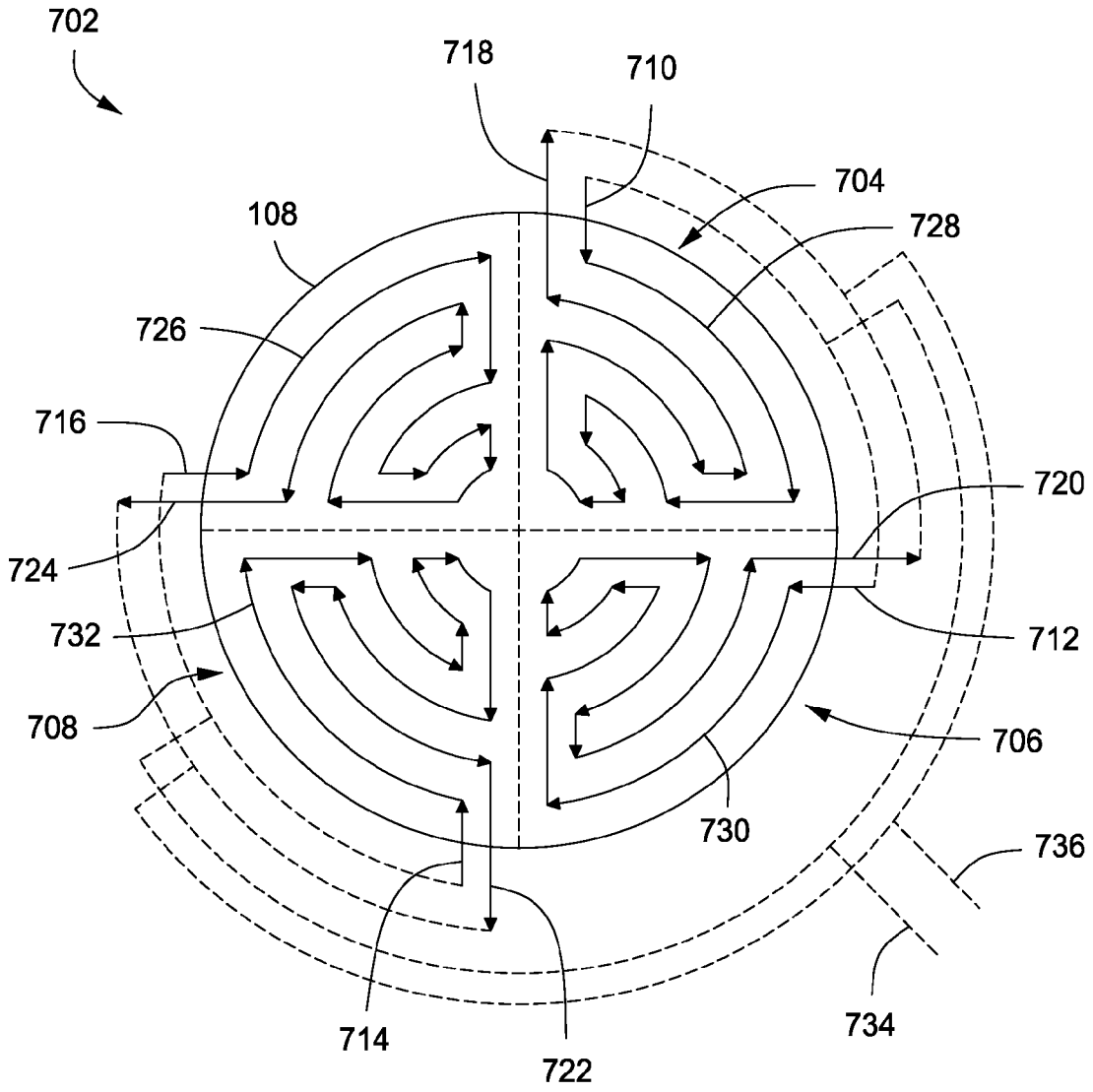
FIG. 7 depicts a flow path of an apparatus for controlling temperature of a substrate in accordance with some embodiments of the present invention.

In some embodiments, and as depicted in FIG. 7, the substrate support may comprise two or more zones (four zones 702, 704, 706, 708 depicted in FIG. 7) arranged in a symmetrical pattern (a fourfold symmetrical pattern in FIG. 7), wherein each of the zones (e.g., 702, 704, 706, 708) includes at least one flow path (e.g., 726, 728, 730, 732) defining a recursive flow pattern in an azimuthal direction about the substrate support 108. In such embodiments, each of the at least one flow paths may comprise a substantially equivalent axial length and cross-sectional area, thus providing substantially equal fluid conductance and residence time. The recursive flow pattern may advantageously provide a symmetrical flow path having a more uniform conductance. As such, the pressure and flow rate within each of the at least one flow paths may be more uniform, resulting in an increased temperature uniformity across the substrate support 108.

In some embodiments, each of the at least one flow paths may comprise an inlet (e.g., 710, 712, 714, 716) and an outlet (e.g., 718, 720, 722, 724), wherein each of the inlets and outlets are coupled to a common inlet (e.g., 734) and a common outlet (e.g., 736). In such embodiments, the distance between each inlet and the common inlet and the distance between each outlet and the common outlet are substantially equivalent, to facilitate a substantially equivalent flow rate of heat transfer fluid, pressure difference, and residence time in each of the flow paths. By providing a common inlet and common outlet in the manner described, each of the flow paths may be provided with heat transfer fluid at the same rate, pressure, and the like. As such, the flow rate of the heat transfer fluid through each flow path may be substantially equal, thereby minimizing temperature non-uniformity associated with transient flow of heat transfer fluid.

In each of the above embodiments, the number of zones and flow path direction may be varied to further facilitate temperature uniformity across the substrate support 108.

While the foregoing is directed to embodiments of the present invention, other and further embodiments of the invention may be devised without departing from the basic scope thereof.

The invention claimed is:

1. An apparatus for controlling the thermal uniformity of a substrate, comprising:

a substrate support having a support surface to support a substrate thereon; and a plurality of flow paths having a substantially equivalent fluid conductance disposed within the substrate support to flow a heat transfer fluid beneath the support surface, wherein each of the plurality of flow paths winds radially inwardly in a reciprocating manner toward a center of the substrate support in a first direction, and, prior to reaching the center, subsequently winds radially outwardly in a reciprocating manner toward a periphery of the substrate support in a second direction different than the first direction.

2. The apparatus of claim 1, wherein the substrate support further comprises:

a plurality of inlets, each respectively coupled to a first end of a respective one of the plurality of flow paths; and a plurality of outlets, each respectively coupled to a second end of a respective one the plurality of flow paths.

3. The apparatus of claim 2, wherein the plurality of flow paths are symmetrically positioned within the substrate support.

4. The apparatus of claim 3, further comprising:

a heat transfer fluid inlet coupled to the plurality of inlets to provide in an inflow of heat transfer fluid to the plurality of inlets; and a heat transfer fluid outlet coupled to the plurality of outlets to provide an outflow of heat transfer fluid from the plurality of outlets.

5. The apparatus of claim 3, wherein each of the plurality of flow paths comprise a winding symmetric pattern.

6. The apparatus of claim 5, further comprising:

a heat transfer fluid inlet coupled to the plurality of inlets to provide in an inflow of heat transfer fluid to the plurality of inlets; and a heat transfer fluid outlet coupled to the plurality of outlets to provide an outflow of heat transfer fluid from the plurality of outlets.

7. The apparatus of claim 1, wherein the plurality of flow paths are arranged in a plurality of zones having radial symmetry with respect to a central axis of the substrate support, wherein each of the plurality of zones comprises at least two flow paths.

8. The apparatus of claim 7, wherein each of the plurality of zones further comprises:

an inlet coupled to the at least two flow paths; and an outlet coupled to the at least two flow paths.

9. The apparatus of claim 1, wherein the plurality of flow paths are coupled to a common inlet and a common outlet.

10. The apparatus of claim 1, further comprising a heat transfer fluid source configured to provide the heat transfer fluid to the plurality of flow paths and to control a temperature and a flow rate of the heat transfer fluid.

11. The apparatus of claim 1, further comprising:

at least one valve respectively coupled to the plurality of flow paths to control a flow rate of the heat transfer fluid.

12. The apparatus of claim 11, further comprising a controller coupled to at least one valve to control the operation thereof.

13. The apparatus of claim 1, wherein the substrate support is disposed in an inner volume of a process chamber.

14. The apparatus of claim 13, wherein the process chamber further comprises at least one heating element disposed proximate the substrate support to compensate for a temperature non-uniformity of the substrate support.

15. The apparatus of claim 14, wherein the at least one heating element comprises a plurality of heating elements arranged in two or more zones.

16. The apparatus of claim 1, wherein the second direction is substantially opposite the first direction.

17. An apparatus for controlling thermal uniformity of a substrate, comprising:

a substrate support having a support surface to support a substrate thereon; and a plurality of flow paths having a substantially equivalent fluid conductance disposed within the substrate support to flow a heat transfer fluid beneath the support surface, wherein each of the plurality of flow paths is independent from a remainder of the plurality of flow paths, wherein each of the plurality of flow paths winds radially inwardly in a reciprocating manner toward a center of the substrate support in a first direction, and prior to reaching the center, subsequently winds radially outwardly in a reciprocating manner toward a periphery of the substrate support in a second direction different than the first direction, and wherein the substrate support further comprises:

an inner portion having a first plurality of the plurality of flow paths disposed therein; and an outer portion having a second plurality of the plurality of flow paths disposed therein, the outer portion disposed radially outward of the inner portion with respect to a center point of the substrate support.

18. The apparatus of claim 17, wherein each of the plurality of flow paths disposed in the outer portion of the substrate support is positioned adjacent to a respective each of the plurality of flow paths disposed in the inner portion of the substrate support.

19. The apparatus of claim 18, wherein each of the plurality of flow paths disposed in the outer portion of the substrate support is configured to provide a flow of heat transfer fluid in an opposite direction with respect to a direction of flow of heat transfer fluid of an adjacent one of the plurality of flow paths disposed in the inner portion of the substrate support.

* * * * *